US005820239A

United States Patent [19]

Christenson et al.

[11] Patent Number: 5,820,239

[45] Date of Patent: Oct. 13, 1998

[54] STORAGE BIN SUPPORTING SYSTEM

[75] Inventors: Robert A. Christenson, Wataga; Jose G. Avendano, Galesburg; Walter I. Disbennett, Knoxville, all of Ill.; Douglas A. Heims, Cedar Rapids, Iowa

[73] Assignee: Maytag Corporation, Newton, Iowa

[21] Appl. No.: 869,250

[22] Filed: Jun. 4, 1997

[51] Int. Cl.[6] ..... A47B 88/00; A47B 96/04

[52] U.S. Cl. ..... 312/334.23; 312/334.14; 312/404; 312/408

[58] Field of Search ..... 312/334.23, 404, 312/408, 334.7, 334.14, 334.24, 350

[56] References Cited

U.S. PATENT DOCUMENTS

| | | | |
|---|---|---|---|
| 807,619 | 12/1905 | Horner | 312/334.14 X |
| 840,874 | 1/1907 | Starkwather . | |
| 843,194 | 2/1907 | Coolbaugh . | |
| 2,065,116 | 12/1936 | Constantine et al. | 312/404 X |
| 2,194,177 | 3/1940 | Rundell | 312/350 |
| 2,253,804 | 8/1941 | Norberg | 312/291 |
| 2,573,272 | 10/1951 | Petkwitz | 312/404 |
| 2,689,778 | 9/1954 | Chambers et al. | 312/350 |
| 3,266,858 | 8/1966 | Klotz | 312/404 X |
| 3,439,967 | 4/1969 | Taylor . | |
| 3,519,319 | 7/1970 | Taylor | 312/334.7 X |
| 3,722,975 | 3/1973 | Taylor . | |
| 4,936,641 | 6/1990 | Bussan et al. | 312/408 |
| 5,577,822 | 11/1996 | Seon | 312/404 |

*Primary Examiner*—Peter M. Cuomo
*Assistant Examiner*—Hanh V. Tran
*Attorney, Agent, or Firm*—Everett G. Diederiks, Jr.

[57] ABSTRACT

A bin for a cabinet is supported by an upper supporting structure for movement between a first position wherein the bin is recessed within the cabinet and a second position wherein the bin is shifted relative to the upper supporting structure in order to access a storage zone of the bin. As the bin is shifted to the second position, at least one projection provided on the bottom of the bin engages a lower supporting structure to relieve stresses on the upper supporting structure. In the preferred embodiment, the bin is mounted in a refrigerator cabinet and a floor of a cabinet liner defines the lower supporting structure. The upper supporting structure is secured to sides of the liner and further engages a ledge integrally formed with the liner. In addition, the bin preferably slides and pivots downwardly upon shifting to the second position in order to maximize the access opening to the storage zone.

20 Claims, 2 Drawing Sheets

STORAGE BIN SUPPORTING SYSTEM

BACKGROUND OF THE INVENTION

1. Field of the Invention

The present invention pertains to the art of storage bins and, more particularly, a supporting system for a storage bin that is slidably and pivotally mounted within a cabinet, such as a refrigerator cabinet.

2. Discussion of the Prior Art

It is extremely commonplace to slidably mount storage bins, including drawers, upon spaced supporting rails thereby enabling the bins to be readily shifted between recessed and storage area access positions. An example of such a known arrangement is represented in U.S. Pat. No. 843,194. These known arrangements typically support the bins for movement upon rollers or within tracks defined by the supporting rails. It is also known in the art to provide for the tilting down of storage bins as they are pulled out in order to make the storage areas more accessible. Examples of this type of configuration are represented in U.S. Pat. Nos. 840,874, 3,439,967 and 3,722,975.

With each of these known types of shifting storage bin arrangements, as the bin is pulled out farther and farther, less of the bin is maintained in contact with the supporting rail structure. Therefore, the weight of the bin and its contents must be supported over a smaller percentage of the overall supporting rail structure. This can obviously lead to rather high stresses in the overlapping portions of both the bin and the rail structure. In order to prevent static or fatigue failure of the storage system, limitations must generally be placed upon the degree to which the bin can be shifted relative to the rail structure in order to assure a minimum amount of overlap, while sacrificing, at least to some degree, the ability to easily access the storage area.

In some environments, the configuration of the structure to which the rails are attached is another important design consideration. For instance, although it is important to maximize the opening associated with a crisper bin in a refrigerator so that large objects such as heads of lettuce, cabbage and the like can be stored therein, the shape of the refrigerator liner places limitations on the permissible length of the supporting rails. In such instances, if the bin is to be pulled out to provide a sufficiently sized opening, the overlap of the bin and the supporting rail structure would be rather small. This small overlap translates into extremely high stresses in concentrated areas of the storage bin system that would eventually lead to system failure.

Based on the above, there exists a need in the art for a storage bin supporting system which will provide for a rather large bin opening so as to enhance access to within the storage area of the bin, while avoiding the concentration of high stresses acting between the bin and the supporting rails even when only a small overlap exists therebetween. In addition, there exists a need in the art for a storage bin supporting system that can be used in particular size constraining environments, such as in a refrigerator cabinet, while still accommodating a rather large bin opening and weight capacity without failure.

SUMMARY OF THE INVENTION

The invention is directed to a storage bin supporting system that includes a bin supported for movement between a first position wherein the bin is recessed within a cabinet and a second position wherein the bin is pulled out from the cabinet to permit access to a storage zone defined by the bin.

More specifically, the bin includes a bottom and front, side and rear walls which extend upwardly from the bottom so as to define a storage zone that is accessible through an upper area of the bin. The bin is movably mounted within a cabinet by supporting structure. Actually, in accordance with a preferred embodiment, a first supporting structure is affixed in a substantially horizontal plane along interior walls of the cabinet and a second supporting structure is carried by the bin. The first and second supporting structures are interengaged in such a manner so as to permit the bin to slide with respect to the cabinet and also to pivot a limited relative degree.

In order to provide additional support for the bin and to maximize the access opening to the storage zone as the bin is shifted to a fully open position, the bottom of the bin is provided with at least one downwardly extending projection that engages a lower supporting structure, such as a floor of the cabinet in which the bin is mounted. When the overlap between the bin and the first supporting structure is at a minimum, a majority of the weight of the bin is supported by the lower supporting structure. Therefore, stresses in the bin and the first supporting structure are substantially reduced in order to protect against system failure. This arrangement is considered to have particular use in the art of refrigerators wherein, due to the interior shape of the refrigerator cabinet as defined by a liner, the permissible length for the first supporting structure is limited, yet the bins must be opened a considerable amount to accept large objects such as heads of lettuce and cabbage.

Additional features and advantages of the invention will become more readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
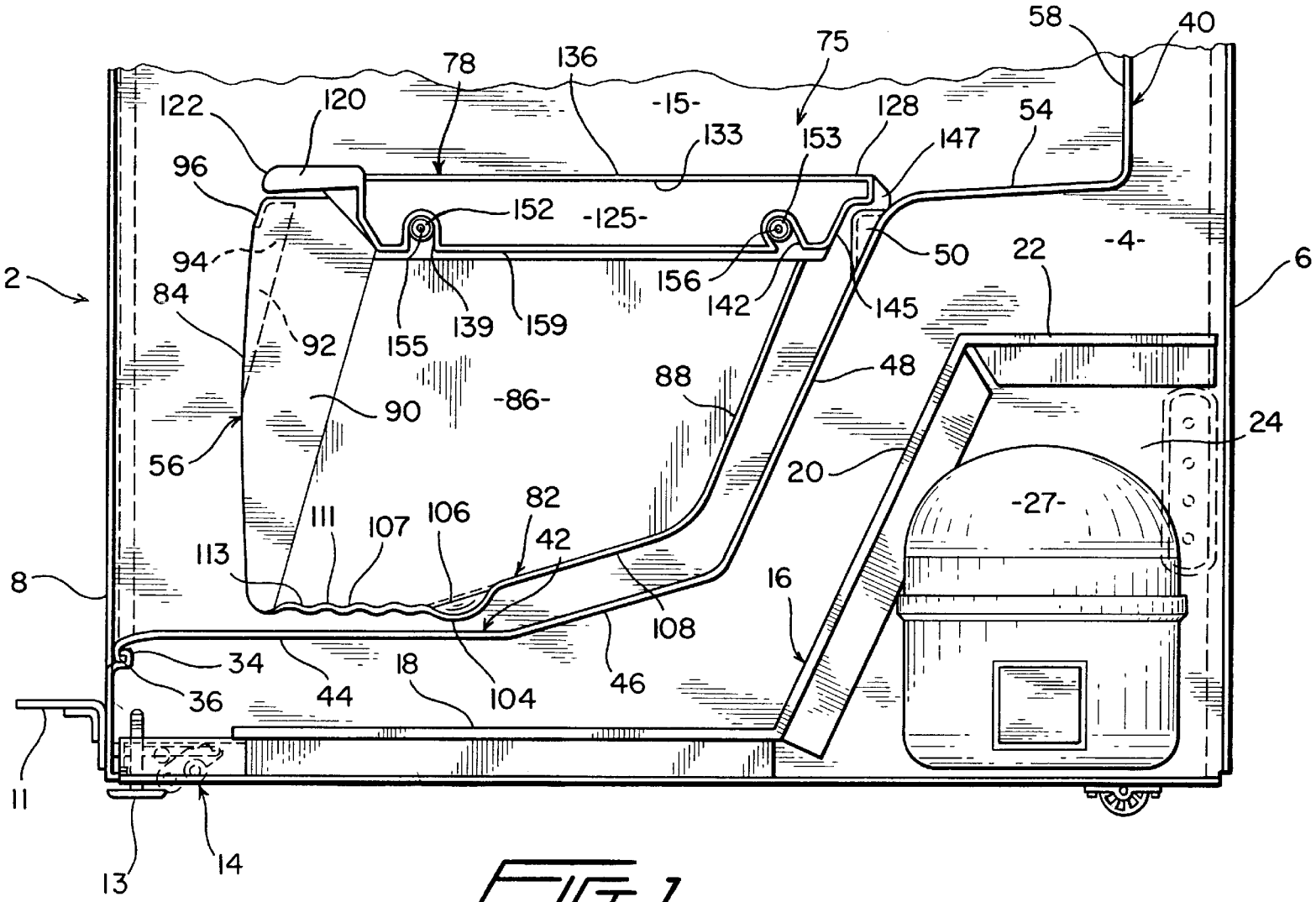
FIG. 1 is a partial open side view of a lower portion of a refrigerator cabinet illustrating the storage bin supporting system of the present invention with the bin in a fully recessed position.

With initial reference to FIG. 1, a lower portion of a refrigerator cabinet 2 is shown. Refrigerator cabinet 2 includes a pair of spaced side panels, one of which is shown at 4, and a top panel (not shown) that are preferably formed from bending a single sheet of metal to which is attached a rear panel 6. At a forward end thereof, side panel 4 leads to a front face 8 which is shown to have fixed thereto a pivot mounting bracket 11 for attaching a refrigerator door (not shown) to cabinet 2. As clearly shown in this Figure, the lower front portion of cabinet 2 can have vertically adjustable legs 13, as well as retractable wheel mechanisms 14. At this point, it should be noted that refrigerator cabinet 2 can take various forms in accordance with the invention, including a side-by-side refrigerator or a refrigerator having vertically spaced freezer and fresh food compartments. In the embodiment shown, cabinet 2 forms part of a top-mount refrigerator having a fresh food compartment 15.

In any event, as shown, refrigerator cabinet 2 has mounted therein a bottom panel unit 16 that includes a first horizontal portion 18, a rearwardly sloping portion 20 and a second horizontal portion 22. At the lower rear end of cabinet 2, bottom panel 16 and cabinet 2 define a chamber 24. Mounted within chamber 24 is a compressor 27 and other components of a refrigeration circuit. Since such a refrigeration circuit is widely known in the art and these components do not form part of the present invention, they will not be further discussed herein. However, the configuration of bottom panel unit 16 does have some significance in the overall invention as will become more fully apparent below.

As is also known in the art, front face 8 is preferably roll-formed so as to define a recess 34 that is adapted to receive a flange portion 36 of a liner 40. Liner 40 actually defines the interior of fresh food compartment 15 and includes a floor 42 having a generally horizontal section 44 and a slight upwardly extending section 46. Section 46 leads to a sharp upwardly extending section 48 that is provided with an upper mounting ledge 50. Finally, the lower portion of liner 40 includes a plateau section 54 that extends to rear wall 58 of liner 40. Liner 40 is preferably molded as a single unit that is simply inserted within refrigerator cabinet 2, with flange portion 36 being received within recess 34, and then maintained in place once foam insulation (not shown for clarity of the drawing) is injected in the areas between liner 40 and the shell of cabinet 2 in a manner known in the art.

Therefore, with the exception of providing ledge 50, the construction and mounting of liner 40 are conventional. What is important to note, however, is that the presence and shape of bottom panel unit 16 dictates, at least to a certain degree, the shape of the lower portion of liner 40. In addition, since this lower portion of liner 40 is the generally desirable location to mount a crisper bin 56 or the like, the particular configuration of this area is extremely important to the overall supporting arrangement for bin 56. More specifically, the shape of liner 40 limits the permissible fore-to-aft length of bin 56, as well as the supporting structure therefor. However, bin 56 needs to still open a relatively large amount (generally in the order of 6–7 inches) in order to accommodate large food items, such as heads of lettuce and cabbage. The present invention is therefore particularly directed to a storage bin supporting system, generally indicated at 75, for use in cabinets having constricted spacial requirements, such as in refrigerator cabinet 2. Storage bin supporting system 75 is specifically designed to enable bin 56 to be shifted a maximum amount relative to supporting structure therefor so as to create a large access opening, while still assuring that the arrangement can withstand static and fatigue loads exerted thereon. A preferred embodiment of the storage bin supporting system 75 will be detailed below with reference for use in refrigerator cabinet 2.

The storage bin supporting system 75 includes bin 56 and upper supporting structure 78. Bin 56 includes a bottom 82, a front wall 84, laterally spaced side walls (one of which is shown at 86) and a rear wall 88. Front, side and rear walls 84, 86 and 88 are interconnected to bottom 82 and extend upwardly therefrom such that bin 56 defines a storage zone (not labeled) therein that is accessible through an open top portion of bin 56. In the preferred embodiment, bin 56 is molded of plastic and front wall 84 is actually created with portions 90 that extend about each side wall 86 for aesthetic and bin reinforcing purposes. Front wall 84 is also provided with a frontal recessed area 92 that defines a cavity 94 located behind a downwardly extending plate 96. Frontal recessed area 92 is provided to permit bin 56 to be manually manipulated by a user inserting fingers within cavity 94 and pulling on downwardly extending plate 96. Bin 56 also includes an upper rim 98 (see FIGS. 2 and 3) that includes an outwardly extending flange 100. Flange 100 actually defines a supporting rail that extends in the fore-to-aft direction of cabinet 2 along at least side walls 86.

In essence, the entire bin structure described directly above is known in the art and is commonly found in many refrigerators available in the marketplace. In accordance with the invention, however, bottom 82 of bin 56 is formed with at least one downwardly extending projection 104. In the preferred embodiment, two laterally spaced projections 104 extend toward one another, from adjacent respective side walls of bin 56 and along portions of bottom 82. Actually, in the preferred embodiment, each projection 104 essentially constitutes a dimpled region that defines an internal depression 106 within bin 56. As shown, each projection 104 is located approximately midway along the length of bottom 82 and, more particularly, at the juncture of a generally horizontal forward section 107 and an upwardly sloping rear section 108 of bottom 82. Forward section 107 is preferably rippled entirely across bottom 82, for reinforcing and enhanced drainage purposes, such that a plurality of crests 111 and troughs 113 are defined between front wall 84 and projections 104. As will be detailed hereinafter, projections 104 are provided to aid in supporting bin 56 when bin 56 is drawn out of cabinet 2 a predetermined amount.

In the preferred embodiment, upper supporting structure 78 constitutes a shelf frame that is mounted within cabinet 2. More specifically, the frame includes an upper front ledge 120, a forwardmost display panel 122, laterally spaced frame sides (one of which is shown at 125) and a rear frame portion 128, all of which are interconnected. Actually, the entire frame structure is preferably integrally molded. Although not shown, front display panel 122 can incorporate manual controls for selectively adjusting a flow of cooling and humidity altering air into bin 56 in a manner also known in the art.

Upper supporting structure 78 is provided, between rear frame portion 128 and upper front ledge 120, with a recessed frame section 133. Positioned within recessed frame section 133 is a shelf defining member 136 that preferably constitutes a piece of glass. Upper supporting structure 78 can be secured within cabinet 2 in various ways. In accordance with the preferred embodiment shown, each of the frame sides 125 is formed with a frontal mounting slot 139 and a forwardly angled rear mounting slot 142. In addition, rear frame portion 128 includes a sloping section 145 that leads to a generally horizontal support portion 147. With this arrangement, upper supporting structure 78 can be readily positioned within cabinet 2 with slots 139 and 142 receiving mounting knobs 152 and 153 that are secured to the sides of liner 40, such as through the use of fasteners (not shown) that extend through central openings 155 and 156 of mounting knobs 152 and 153 and into liner 40, while support portion 147 rests upon ledge 50 of liner 40.

Each frame side 125 is also formed with an inwardly projecting lower rail 159 that runs along substantially the entire length of the side 125, as well as a central rail 161 (see FIGS. 2 and 3) that is spaced above lower rail 159. Therefore, each frame side 125 defines an inner track 163 between a respective lower and central rail set 159 and 161. With this construction, bin 56 can be slidably supported by upper supporting structure 78 with the flange 100 provided at each side wall 86 of bin 56 being received within a respective track 163. Actually, each flange 100 rests upon a respective lower rail 159 and central rails 161 merely limit permissible upward movement of bin 56.

At this point, it should be noted that slidably mounting bins within frame defined tracks in the manner described above is known in the art of cabinets, although the particular manner in which upper supporting structure 78 is secured within cabinet 2 is considered an improvement over such known arrangements. It should also be realized that upper supporting structure 78 could be sized to support a single bin 56 or could also be provided with central frame tracks such that two or more bins could be arranged laterally adjacent one another within cabinet 2. For example, in the art of refrigerators, it is not uncommon to provide a single bin 56 in a lowermost fresh food compartment in a side-by-side type refrigerator cabinet while providing multiple, laterally spaced bins in a corresponding area of a top mount refrigerator given the difference in the lateral dimensions in the relative compartments of these types of refrigerators. Therefore, it should be understood that the present invention should not be limited in this regard and is equally applicable to numerous types of cabinets.

Figure 2:
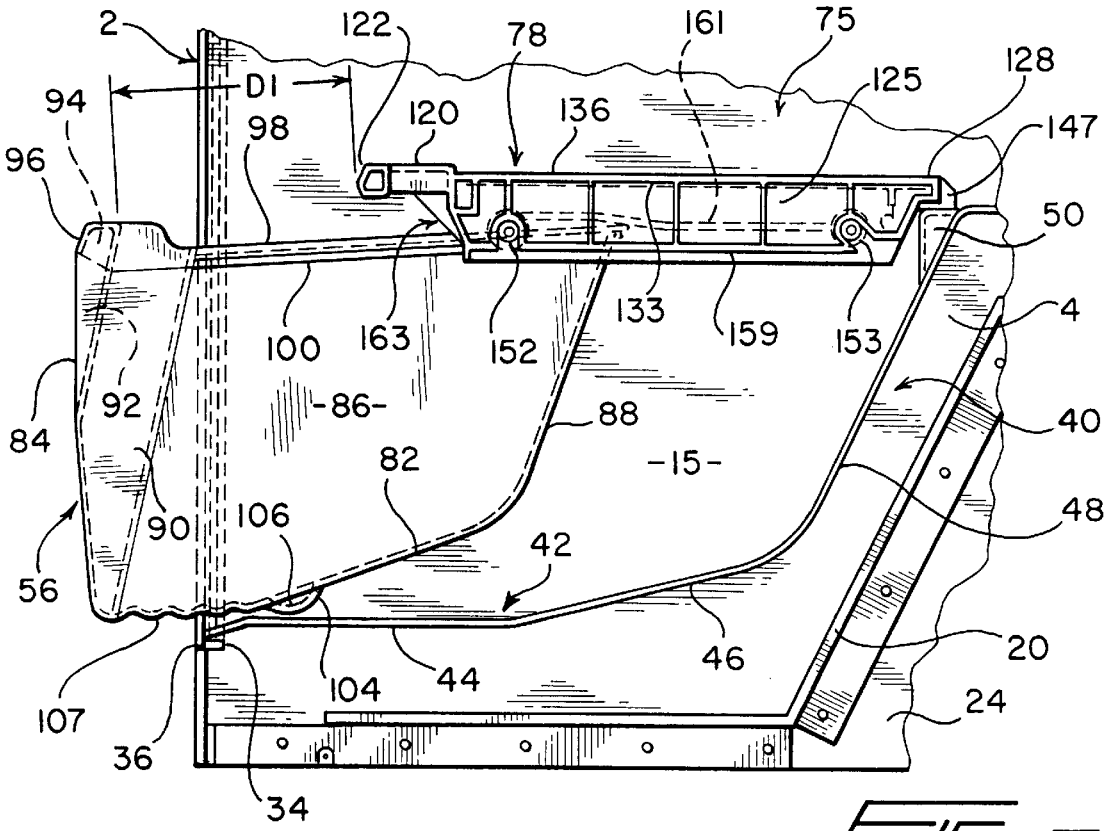
FIG. 2 is a side view similar to that of FIG. 1, but with the bin in a partially extended position.
Figure 3:
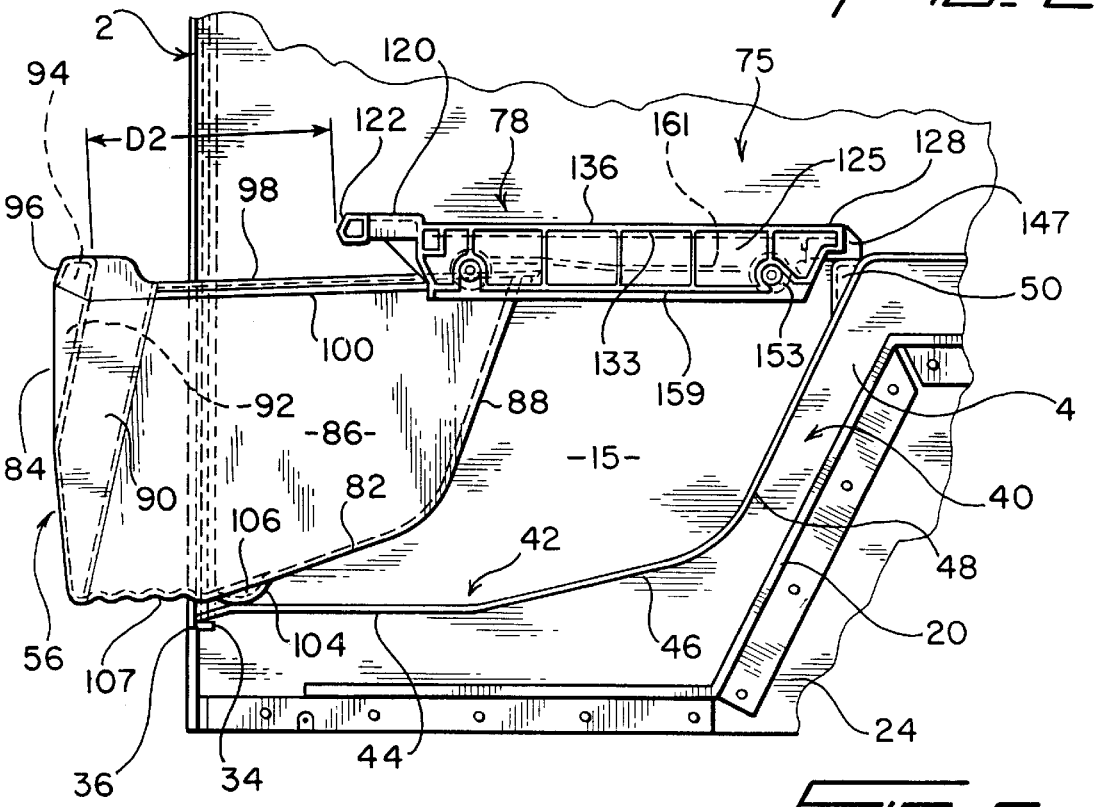
FIG. 3 is a side view, similar to that of both FIGS. 1 and 2, but with the bin in a fully extended position.

The manner in which the storage bin supporting system 75 of the present invention operates will now be described in detail. As indicated above, FIG. 1 depicts bin 56 in a fully recessed or retracted position within cabinet 2. In this position, bin 56 fully rests upon upper supporting structure 78. More specifically, the upper flange 100 on each side wall 86 of bin 56 rests upon a respective lower rail 159. When it is desired to access the storage zone defined by bin 56, a user will slide bin 56 out of cabinet 2 a predetermined amount by pulling on plate 96. During initial movement of bin 56, each flange 100 will continue to slide along a respective lower rail 159. Of course, the degree of overlap between each flange 100 and lower rail 159 will diminish as bin 56 is pulled further out of cabinet 2. At some point, bin 56 will be caused to tilt downwardly relative to upper supporting structure 78, as well as cabinet 2, due to the weight of bin 56 and its contents. The degree of tilting will be limited due to the engagement of each flange 100 with a respective set of lower and central rails 159 and 161. This position is illustrated in FIG. 2. In the preferred embodiment shown, this position is assumed when front wall 84 is spaced from display panel 122 a distance D1 of approximately six (6) inches. It is just after this point that dangerously high stresses have been found to exist in upper supporting structure 78, as well as bin 56, that could lead to failure of the system. Therefore, at this point, projections 104 are adapted to abut floor 42 which functions as a lower support for a substantial portion of the weight of bin 56 and its contents. As bin 56 is further shifted out of cabinet 2, nearly all the weight of bin 56 and its contents is borne by floor 42 of liner 40. This position is illustrated in FIG. 3 wherein front wall 84 of bin 56 is spaced a distance D2 of approximately seven (7) inches from display panel 122. Although not shown, bin 56 is preferably provided with a tab or the like which abuts a portion of upper supporting structure 78 to prevent bin 56 from being slid completely out of cabinet 2.

Based on the above discussion, it should be readily apparent that the storage bin supporting system 75 of the present invention provides for a reliable storage arrangement by effectively distributing the weight of bin 56 and its contents during critical times as bin 56 is shifted relative to cabinet 2. In addition, the storage bin supporting system 75 enhances the accessibility of the storage zone within bin 56 by enabling bin 56 to be slid out of cabinet 2, as well as tilted, a substantial amount, even though the area in cabinet 2 wherein bin 56 is located only permits a reduced fore-to-aft length for the rails 159 and 161 of supporting structure 78.

Although described with reference to a preferred embodiment of the invention, it should be understood that various changes and/or modifications may be made to the invention without departing from the spirit thereof. For example, although the upper supporting structure in the preferred embodiment described constituted tracks defined by rail members, this supporting structure could equally be defined by rollers, liner formed rails or the like without departing from the spirit of the invention. Furthermore, although bin 56 both slides and pivots in the embodiment described in order to maximize the access opening to the storage zone of bin 56, it would be possible to permit only one type of movement of bin 56 and to alter the shape of the floor 42 of liner 40 such that bin 56 is still supported thereon in order to avoid failure of the overall system. In addition, although the preferred embodiment incorporates a pair of laterally spaced projections that are defined by dimpled regions formed in the bottom of the bin, additional dimpled regions or an elongated trough-like projection could also be provided to accomplish the supporting function. In general, the invention is only intended to be limited by the scope of the following claims.

I claim:

1. In a cabinet including an interior compartment defined, at least in part, by interior side walls and a floor, a storage bin supporting system comprising:

a bin including a bottom and front, side and rear walls extending upwardly from said bottom, said bottom and front, side and rear walls being interconnected so as to collectively define a storage zone accessible through an upper area of said bin;

first supporting structure secured in a substantially horizontal plane within said cabinet;

second supporting structure carried by said bin, said second supporting structure being movably supported upon said first supporting structure so as to enable said bin to be selectively shifted between a recessed position within said compartment and an extended position permitting access to within said storage zone;

third supporting structure arranged within said cabinet below said bin; and at least one projection extending downwardly from the bottom of said bin, said projection engaging said third supporting structure, at a location forward of the bin in the recessed position, when said bin is shifted from said recessed position to said extended position to further support said bin.

2. The storage bin supporting system according to claim 1, wherein said bin is supported by said first supporting structure for relative sliding and pivoting movement.

3. The storage bin supporting system according to claim 2, wherein said third supporting structure constitutes the floor of said compartment.

4. The storage bin supporting system according to claim 3, wherein said first supporting structure is affixed along the interior side walls of said compartment.

5. The storage bin supporting system according to claim 1, wherein the at least one projection is integrally formed with the bottom of said bin.

6. The storage bin supporting system according to claim 3, wherein the at least one projection has an arcuate lower surface adapted to engage the floor of said cabinet.

7. The storage bin supporting system according to claim 1, wherein said at least one projection is provided intermediate the front and rear walls of said bin.

8. The storage bin supporting system according to claim 7, further comprising multiple trough portions arranged between the front wall of said bin and said at least one projection.

9. The storage bin supporting system according to claim 1, wherein said first supporting structure includes side portions formed with a pair of spaced slots for use in securing said first supporting structure within said cabinet.

10. The storage bin supporting system according to claim 9, wherein at least one of said pair of slots is angled with respect to a vertical axis.

11. The storage bin supporting system according to claim 1, wherein said first supporting structure forms part of a shelf defining frame.

12. The storage bin supporting system according to claim 11, wherein said cabinet constitutes a refrigerator cabinet having a liner therein that defines the interior compartment.

13. The storage bin supporting system according to claim 12, wherein said liner includes a rear wall portion and an intermediate section interconnecting the floor and the rear wall portion, said intermediate section being formed with a ledge, said first supporting structure being engaged with said ledge.

14. A method of accessing a storage zone of a bin that is slidably mounted for movement between recessed and extended positions upon upper supporting structure within a cabinet comprising:

providing at least one projection extending from a bottom of said bin;

shifting the bin from upon the upper supporting structure a predetermined amount in order to access the storage zone; and moving the bin such that the at least one projection engages lower supporting structure within said cabinet at a location forward of the bin in the recessed position.

15. The method according to claim 14, further comprising: slidably mounting the bin upon the upper supporting structure and tilting the bin downward to engage the lower supporting structure.

16. The method according to claim 15, further comprising: maintaining the at least one projection in contact with the lower supporting structure while said bin is continually drawn from said cabinet.

17. The method according to claim 15, further comprising: providing the bin within a refrigerator cabinet having a liner to which the upper supporting structure is secured and a floor that defines the lower supporting structure.

18. The method according to claim 17, further comprising: forming the liner with a rear ledge and resting the upper supporting structure thereon.

19. The method according to claim 14, further comprising: integrally forming the at least one projection in the bottom of said bin.

20. In a refrigerator cabinet including an interior compartment defined, at least in part, by a liner having interior side walls and a floor, a storage bin supporting system comprising:

a bin including a bottom and front, side and rear walls extending upwardly from said bottom, said bottom and front, side and rear walls being interconnected so as to collectively define a storage zone accessible through an upper area of said bin;

first supporting structure secured in a substantially horizontal plane within said cabinet;

second supporting structure carried by said bin, said second supporting structure being movably supported upon said first supporting structure so as to enable said bin to be selectively shifted between a recessed position within said compartment and an extended position permitting access to within said storage zone; and third supporting structure arranged within said cabinet below said bin, said third supporting structure being constituted by the floor of the liner, wherein, when said bin is shifted from said recessed position to said extended position, the bottom of the bin engages the third supporting structure, at a location forward of the bin in the recessed position, to further support said bin.

* * * * *